US006852958B2

(12) United States Patent
Germain et al.

(10) Patent No.: US 6,852,958 B2
(45) Date of Patent: Feb. 8, 2005

(54) MICROWAVE HEATING CONTAINER

(75) Inventors: Alain Germain, Bourg la Reine (FR); André-Jean Berteaud, Le Kremlin Bicetre (FR); Mostafa El Haba, Corbeil Essonnes (FR); Patrick Mahe, Ormesson (FR)

(73) Assignee: Microondes Energie Systèmes, Villejuif (FR)

( * ) Notice: Subject to any disclaimer, the term of this patent is extended or adjusted under 35 U.S.C. 154(b) by 0 days.

(21) Appl. No.: 10/363,505

(22) PCT Filed: Aug. 30, 2001

(86) PCT No.: PCT/FR01/02698

§ 371 (c)(1),
(2), (4) Date: Jun. 18, 2003

(87) PCT Pub. No.: WO02/18231

PCT Pub. Date: Mar. 7, 2002

(65) Prior Publication Data

US 2004/0031788 A1 Feb. 19, 2004

(30) Foreign Application Priority Data

Sep. 1, 2000 (FR) ..... 00 11171

(51) Int. Cl.[7] ..... H05B 6/78

(52) U.S. Cl. ..... 219/700; 219/728; 219/736; 219/701; 219/699; 219/698; 219/679; 219/729

(58) Field of Search ..... 219/700, 728, 219/736, 701, 699, 698, 679, 729

(56) References Cited

U.S. PATENT DOCUMENTS

| | | | | |
|---|---|---|---|---|
| 4,416,907 A | | 11/1983 | Watkins | |
| 4,831,224 A | * | 5/1989 | Keefer | 219/728 |
| 5,514,853 A | * | 5/1996 | Le Viet | 219/700 |
| 5,593,610 A | | 1/1997 | Ball et al. | |
| 5,961,872 A | * | 10/1999 | Simon et al. | 219/729 |
| 5,986,248 A | | 11/1999 | Matsuno et al. | |

FOREIGN PATENT DOCUMENTS

| | | |
|---|---|---|
| EP | 0 246 041 | 11/1987 |
| EP | 0 271 981 | 6/1988 |
| WO | WO 92 19511 A | 11/1992 |

* cited by examiner

*Primary Examiner*—Shawntina Fuqua
(74) *Attorney, Agent, or Firm*—Dennis G. LaPointe

(57) ABSTRACT

Container designed to contain a product having to be heated by applying microwaves, the container having a side wall (10) and an end wall (12) formed by a base or a lid and means (10A) for limiting the penetration of the microwaves through the side wall (10), compared with the penetration of the microwaves through a central region of the end wall (12). Advantageously, the container according to the invention further comprises means (12A) for concentrating the microwaves in a central region of the end wall (12), the said means being formed by an excess thickness of a dielectric material, the dielectric constant of which is at least equal to 1.5, preferably greater than 2.

24 Claims, 3 Drawing Sheets

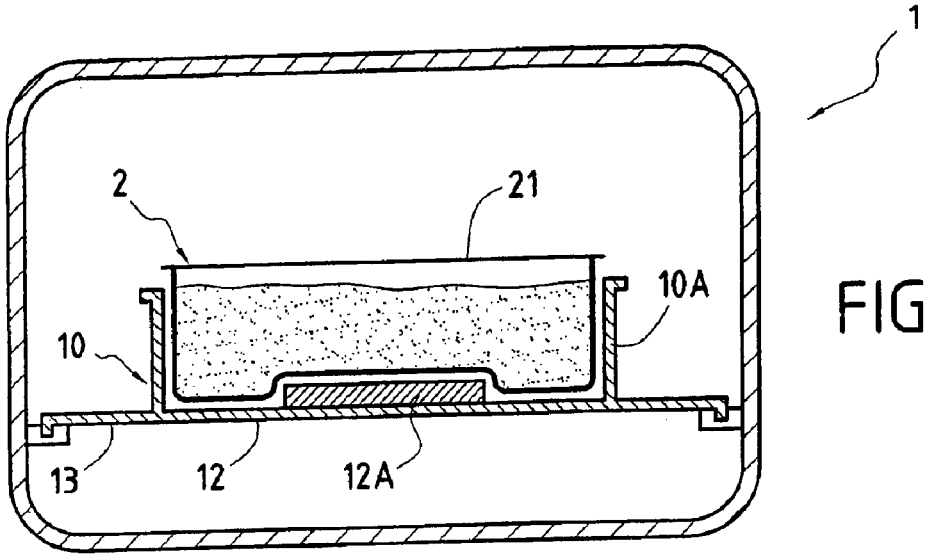
FIG.4
FIG.5
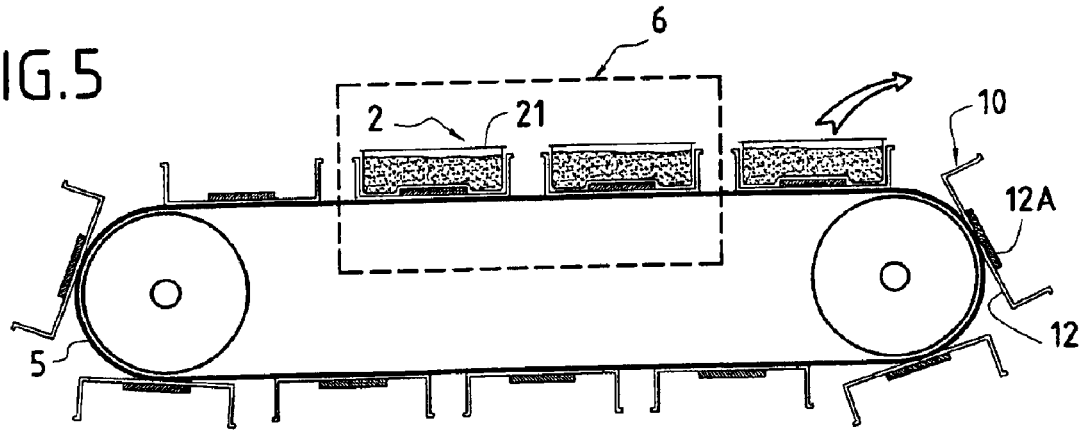
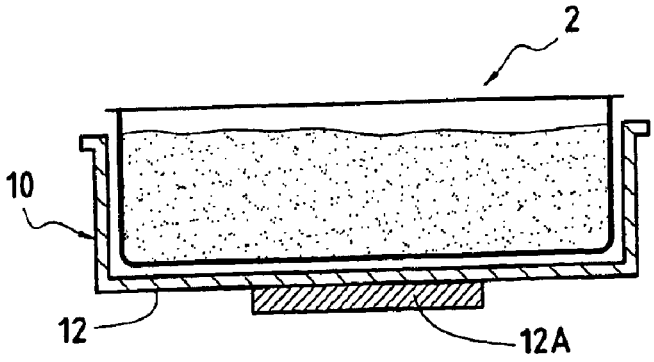
FIG.6

MICROWAVE HEATING CONTAINER

The present invention relates to a container designed to contain a product having to be heated by applying microwaves, the container having a side wall and an end wall formed by a base or a lid.

In particular, such a container is designed to contain a food product. Microwaves are commonly used domestically for reheating such a product before its consumption. They are also used in the food industry in order to bring the product to a temperature allowing it to be pasteurized or sterilized. This is because microwaves provide a temperature rise which is extremely fast in comparison with other heating means. It will be recalled that microwaves are electromagnetic waves whose frequency is between 0.3 GHz and 300 GHz, more particularly between 0.3 GHz and 5.2 GHz.

For both of these types of use, it is desirable for the product contained in the container to be heated as uniformly as possible.

This is particularly the case, for domestic applications, when microwaves are used as heating and defrosting means, in order to prevent the presence of cold zones.

When used industrially for the purpose of pasteurizing or sterilizing the product contained in the tray, the temperature differences between the various zones of this product must be extremely small. It is in fact necessary that the entire product is definitely brought to a high enough temperature, while preventing some zones of the product being heated too much, in which case they would be denatured.

Containers consisting of trays made of a dielectric material such as polypropylene are commonly used. It has been found with such trays that the product is heated more in the region of the edges of the tray than in its central region. The temperature difference may be about 35° C.

Based on this finding, the present invention aims to improve the known containers in order to promote uniform heating of the product using microwaves.

Thus, the present invention relates to a container designed to contain a product having to be heated by applying microwaves, having a side wall and an end wall formed by a base or a lid, and comprising means for limiting the penetration of the microwaves through the side wall.

According to the invention, the container further comprises means for concentrating the microwaves in a central region of the end wall, the said means being formed by an excess thickness of a dielectric material, the dielectric constant of which is at least equal to 1.5, preferably greater than 2.

Preferably, the dielectric constant of the dielectric material is between 2 and 4.

The excess thickness is made from a solid dielectric material whose dielectric constant is greater than that of air, which is equal to 1. The presence of such an excess thickness locally causes a concentration of the microwave field. In other words, it makes it possible locally to increase the heating effect due to the scattering of the microwaves.

The applicant has found that the excess thickness defined above forms a particularly simple means for substantially reduces the inner volume of the tray, unlike the excess thickness according to the invention.

This prior art therefore has a quite relative efficiency since the microwaves are not really concentrated, the protuberance serving more to orient the microwave field substantially perpendicular to its surface in contact with the product or turned towards it than to concentrate the microwaves. Moreover, the inner volume of the tray is considerably reduced by the presence of the protuberance.

Document EP 0 271 981 presents a container whose lid may have an excess thickness placed so as to generate a microwave propagation mode of a higher order than the fundamental modes of the container.

This document does not recognize the benefit of concentrating the microwaves in a central region of the base or of the lid of the container and, at the same time, of limiting the penetration of the microwaves through the side wall.

The present invention makes it possible to overcome the aforementioned drawbacks and presents a simple and efficient solution to the problems which have just been stated.

The technical effect obtained according to the invention is such that a screening effect is obtained on the edges of the container compared with an amplifying effect, itself produced in the central region of this container. Thus excessive heating of the zones of the product close to the edges of the container is avoided, while heating of the zones of the product located in the central region of this container is enhanced.

Moreover, the excess thickness according to the invention commonly has a height of between about 2 mm and about 6 mm.

Advantageously, the side wall comprises an electrically conducting material.

This material partially absorbs or reflects the electric field in the region of the side wall of the container. The presence of such a material therefore constitutes a simple means for limiting the penetration of the microwaves through this side wall.

Advantageously, the container is mainly formed from an underlying dielectric material to which an electrically conducting material is joined locally on the side wall.

Thus an effect of smoothing the temperature gradient between the various zones of the product contained in the container is obtained, since the heating decreases in the vicinity of the edges, while it increases in the central region.

The underlying dielectric material has a dielectric constant greater than 1 and, advantageously, greater than 1.5 and even 2. The excess thickness may be formed from the same material.

Depending on the application, the electrically conducting material may be embedded in the underlying dielectric material or else fastened thereto.

The underlying dielectric material has a dielectric constant greater than 1 and, advantageously, greater than 1.5 and even 2. The excess thickness may be formed from the same material.

Depending on the application, the electrically conducting material may be embedded in the underlying dielectric material or else fastened thereto.

Furthermore, the excess thickness may be formed as a single piece with the outer wall of the container or else fastened thereto.

Advantageously, the ratio of the height of the excess thickness to the depth of the container is less than 0.3, preferably of the order of 0.1. This means that the excess thickness occupies only a limited height in the container, thus allowing a maximum volume of product contained in the container.

The container may directly contain the product before being heated by microwaves or else, as a variant, it may accommodate a package itself containing such a product.

This package may be conventional and may, for example, consist of a simple conventional tray made of polypropylene not having any particular means for distributing the penetration of the microwaves. In this case, heating the product while this package is placed in the container of the invention makes it possible for the product to be uniformly heated.

For example, the container may constitute a tool or part of a microwave oven, or even be incorporated into the cavity of this oven, for example by being fastened to the floor.

The invention is also applicable to a system for heating using microwaves, comprising a conveyor and microwave application means capable of heating a product transported by this conveyor by means of microwaves. According to the invention, the conveyor is equipped with at least one container complying with the invention.

These containers may accommodate packages such as trays and the like, filled with product to be heated and/or pasteurized or sterilized by the microwaves. The system may operate continuously or in a subsequent step with means for manufacturing and filling the packages. Thus, by virtue of the system of the invention, the product contained in these packages is able to be subjected to uniform heating without altering the packages compared with the conventional packages.

The invention will be better understood and its advantages will become apparent on reading the following detailed description of embodiments shown by way of non-limiting examples.

The description refers to the appended drawings in which:

FIG. 4 illustrates an application in which a container according to the invention is incorporated into the cavity of a microwave oven;

FIG. 5 shows a container according to the invention incorporated into a conveyor belt; and FIG. 6 is a section through a particular container.

Figure 2:
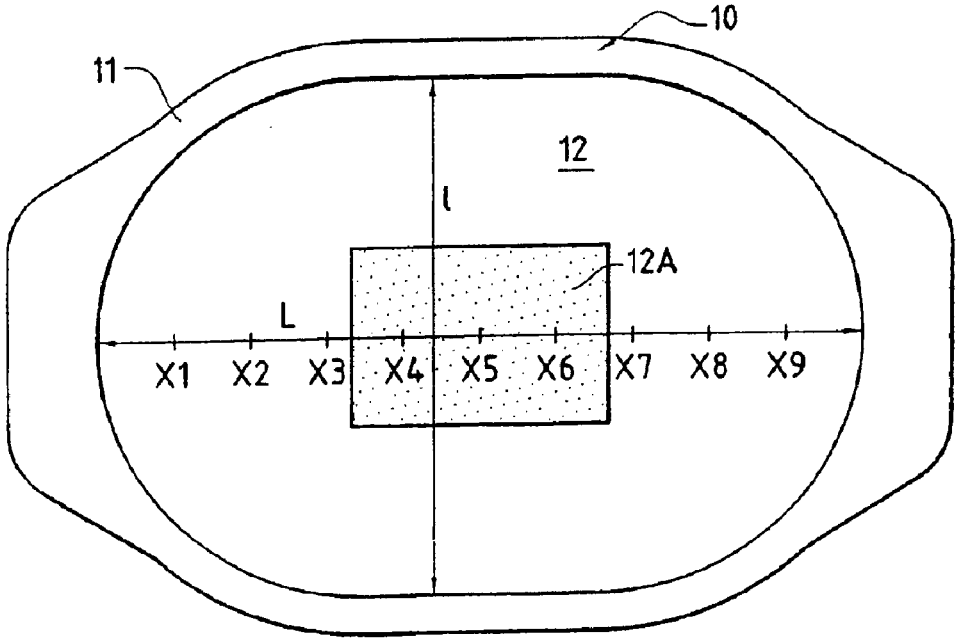
FIG. 2 is a top view of the container of FIG. 1.

The container according to the invention is generally flat or in the form of a tray and has a side wall 10, and a base 12. For example, as can be seen in FIG. 2, its outline, determined by the shape of the side wall, is oval. It may of course have a different shape, for example square or rectangular with rounded corners.

For applications in the food sector, the depth of the container is generally between 30 mm and 50 mm.

Figure 1:
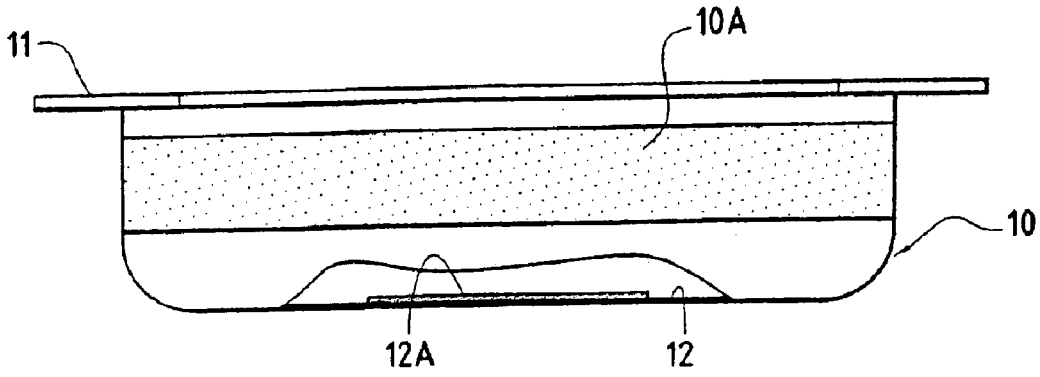
FIG. 1 is a side view of a container according to the invention.

FIG. 1 shows a strip 10A which, in this instance, extends over the entire perimeter of the side wall 10. This strip comprises an electrically conducting material. For example, the container is made from a dielectric material such as polypropylene or glass. In the region of the strip 10A, an electrically conducting material is added to this underlying dielectric material.

The electrically conducting material may be formed by a metal strip embedded in the underlying dielectric material, it being possible for the latter to be, for example, overmoulded onto this strip. The electrically conducting material may also be formed by a strip which is fastened, by welding, adhesive bonding or the like, to the side wall of the container. It is also possible to use the marking (by means of a label or an ink) of the container in order to affix the electrically conducting material.

The electrically conducting material may also be formed by particles (powder, ink or conducting composition, etc.) which are embedded in the underlying dielectric material and concentrated in the region of the strip 10A.

In general, the electrically conducting material is chosen from any type of material which absorbs or reflects the electric field. This includes, for example, metal, carbon or any suitable conducting composition.

The base 12 of the container comprises an excess thickness 12A placed in its central region. This excess thickness is made from a dielectric material which locally concentrates the microwaves and makes it possible to increase the heating effect in the central region of the container. For example the excess thickness 12A may be formed by a plate made of a dielectric material which is fastened, for example by welding or adhesive bonding, to the base of the container.

However, it will be noted that, since the container is preferably made from an underlying dielectric material, it is advantageous for the excess thickness to be formed as a single piece with the end wall of the container. For example, this container is made by moulding and its wall made of a dielectric material has a substantially constant thickness over its entire surface, except for a central region of the end wall, in which the thickness is increased.

Without departing from the scope of the invention, the excess thickness may form a protuberance outside the cavity formed by the container, as illustrated in FIG. 6.

This embodiment will preferably be chosen in relation to certain applications of the invention which will be described hereinbelow.

The "usual" thickness of the container wall is about 0.5 mm to 1 mm, while its thickness in the zone 12A is about 2 to 6 mm.

Moreover, the ratio between the excess thickness 12A and the depth of the container is commonly about 0.1, and preferably remains less than 0.3.

In FIG. 2, it can be seen that the excess thickness 12A is of rectangular shape. Of course, the outline of the excess thickness may be, by reduction, similar to that of the container. Thus, it may for example be oval.

By way of illustration, the ratio of the area occupied by the excess thickness to the total area of the base of the container is about ⅓.

Thus, the ratio of the thickness to the area of the excess thickness is between about 0.05 and 0.1.

The container may comprise a lid formed from a simple peelable film fastened to the edge 11 of its side wall 10, or else by a wall element placed through the side wall and possibly engaging with the edge 11 of this wall by snap-fastening or the like.

It is possible to choose that it is the lid rather than the base 12 of the container which has the excess thickness made of a dielectric material. It is also possible to choose that the lid and the base each comprise an excess thickness, the dimensions of which will possibly be not as much.

To form the excess thickness, it is possible to choose a dielectric material for example from the group of Teflon®, mica, Samicanite® or else polypropylene or glass, this list not being exhaustive. These materials have the common fact of having a dielectric constant greater than 1.5 and even than 2.

Figure 3:
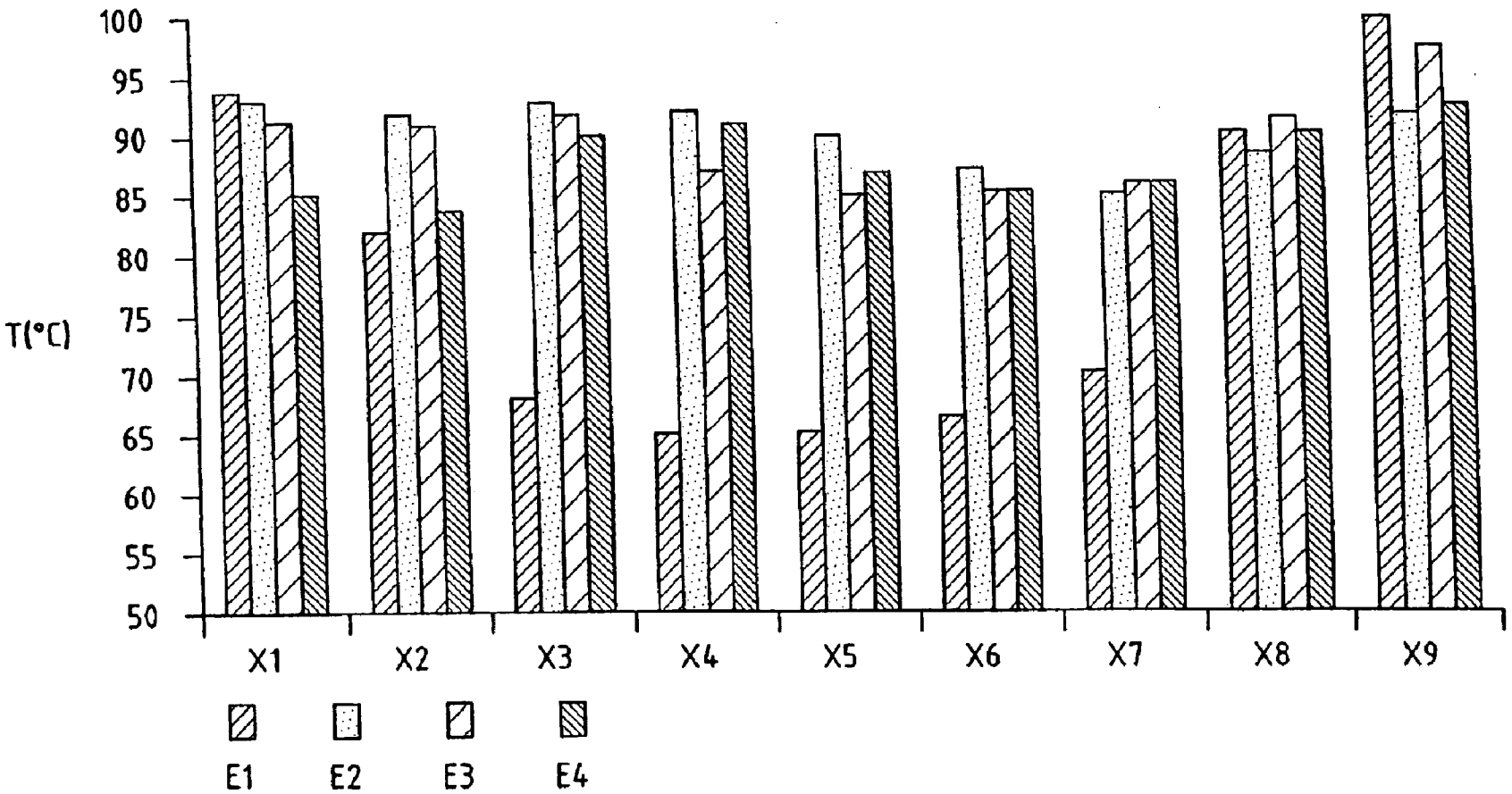
FIG. 3 is a diagram illustrating, for various types of containers having the same dimensions, temperature measurements made in various zones of this container.

By way of illustrative example, FIG. 3 shows the result of temperature measurements carried out with various containers. These containers have the overall shape of that shown in FIGS. 1 and 2. The various measurement points are indicated in FIG. 2 by the references X1 to X9, these points being evenly spaced and the point X5 being in the centre.

For the tests, the containers were filled with 410 g of mashed potato. The tests were carried out for a heating time of 5 min and with microwaves having a power of 800 W. For test No. E1, a polypropylene tray weighing 28 g was used. It can be seen that, close to the edges of this tray, the temperature reached maximum values of about 95 to 100° C. while, in the central region, the temperature remained at about 65° C., that is a temperature gradient close to 35° C.

For test No. E2, the same tray was used, to which a strip of metal was added around the entire side wall, this strip having a thickness of 15 to 20 μm and an electrical surface resistance of 20 to 50 Ω/square. A small rectangular plate of Teflon® measuring 105×50 mm and with a thickness of 3 mm was also adhesively bonded to the lower wall of this tray. This time, the maximum temperature reached each was about 93° C., at measurement points X1 and X3, that is to say not only on the edges. The minimum temperature is about 85° C. at point X7. In other words, it can be considered that the contents of the tray have successfully been heated to about 90° C.±5° C.

For test No. E3, the tray had the same metal strip but, this time, a small polypropylene tray measuring 105 mm×50 mm and with a thickness of 5 mm was adhesively bonded to the lower face of the tray. The maximum temperature reached was about 97° C., at point X9. The minimum temperature was about 85° C., at points X5 and X6.

Finally, for test No. E4, the tray with the same metal strip was used with a small mica silicone plate measuring 105×50 mm and with a thickness of 3 mm. The maximum temperature reached at point X9 was about 92° C., while the minimum temperature reached at point X2 was about 83° C.

Thus, with the tray made solely from polypropylene, a temperature gradient between the various measuring points which was about 35° C. was obtained. On the other hand, with a tray according to the invention, used for tests E2 to E4, the temperature gradient was only about 10° C., that is a median temperature of about 90° C.±5° C.

According to one beneficial application, the invention may relate to a container designed directly to contain a product having to be pasteurized, sterilized or reheated. According to another application, it may also involve a tool for a microwave oven intended to contain a container such as a tray, package or the like, itself directly containing the product having to be treated.

FIG. 4 relates to one application of the invention in which the container is incorporated into a microwave oven 1. More specifically, the base 12 of the container forms part of the floor 13 of the oven 1 or is fastened thereto. Of course, the container has the features inherent to the invention as stated above. A package 2, containing the product to be treated, may be placed in the container, as illustrated in this figure. The package 2 may be provided with a lid 21 when for example is involved pasteurizing the product contained therein.

Preferably, the package has a shape identical to that of the inside of the container in order to avoid empty spaces between these two elements. The shape of the flat-based container illustrated in FIG. 6, in which the excess thickness projects outwards from the container, is, in this regard, somewhat advantageous.

Without departing from the scope of the invention, the container may form part of a conveyor belt 5 as illustrated in FIG. 5, in the case, for example, of a line for preparing food products.

The container then forms part of a system as illustrated schematically in FIG. 5.

Upstream of this system, the packages 2 may undergo various treatments: be filled with product, sealed by a lid (21), etc.

In the system, each package 2 is placed in a container 10 then the combination is taken by the conveyor belt 5 to a microwave enclosure 6 where it is subjected, for a given time, to microwave radiation. This makes it possible to carry out, as appropriate, reheating, pasteurization or any other treatment.

The belt 5 may move past continually or else step by step to the enclosure 6. Once it has left the enclosure 6, the package 2 is taken from the container (10, 12, 12A) (manually or automatically) in order to undergo another treatment in the preparation line or to be packaged for sale.

What is claimed is:

1. A container designed to contain a product having to be heated by applying microwaves, having a side wall (10) and an end wall (12) formed by a base or a lid, the container comprising means (12A) for concentrating the microwaves in a central region of the end wall (12) which are formed by an excess thickness (12A) made from a dielectric material whose dielectric constant is at least equal to 1.5, wherein the container is mainly formed from an underlying dielectric material and further comprises means (10A) for limiting the penetration of the microwaves through the side wall (10) which are formed by locally joining an electrically conducting material (10A) to the said side wall so that this electrically conductive material (10A) partially absorbs or reflects an electrical field in the region of said side wall.

2. The container according to claim 1, wherein the dielectric constant is between 2 and 4.

3. The container according to claim 1, wherein the excess thickness (12A) is formed from a material from the group of Teflon®, mica, mica silicone, polypropylene and glass.

4. The container according to claim 1, wherein the excess thickness (12A) has a height of between about 2 mm and about 6 mm.

5. The container according to claim 1, wherein the electrically conducting material (10A) is embedded in the underlying dielectric material.

6. The container according to claim 1, wherein the electrically conducting material (10A) is fastened to the underlying dielectric material.

7. The container according to claim 1, wherein the excess thickness (12A) is formed as a single piece with the end wall (12) of the container which is formed in the said underlying dielectric material.

8. The container according to claim 1, wherein the excess thickness (12A) is fastened to the end wall (12).

9. The container according to claim 1, wherein the ratio of the height of the excess thickness (12A) to the depth of the container is less than 0.3.

10. The container according to claim 1, wherein the container constitutes a tool or part of a microwave oven (1).

11. A system for heating using microwaves, comprising:

a conveyor (5) and microwave application means (6) capable of heating a product transported by this conveyor by means of microwaves, wherein the conveyor (5) is equipped with a container designed to contain the product having to be heated by applying the microwaves means, having a side wall (10) and an end wall (12) formed by a base or a lid, the container comprising means (12A) for concentrating the microwaves in a central region of the end wall (12) which are formed by an excess thickness (12A) made from a dielectric material whose dielectric constant is at least equal to 1.5, wherein the container is mainly formed from an underlying dielectric material and further comprises means (10A) for limiting the penetration of the microwaves through the side wall (10) which are formed by locally joining an electrically conducting material (10A) to the said side wall.

12. The container according to claim 1, wherein the dielectric material has a dielectric constant greater than 2.

13. The container according to claim 1, wherein the ratio of the height of the excess thickness (12A) to the depth of the container is about 0.1.

14. The system according to claim 11, wherein the dielectric constant is between 2 and 4.

15. The system according to claim 11, wherein the excess thickness (12A) is formed from a material from the group of Teflon®, mica, mica silicone, polypropylene and glass.

16. The system according to claim 11, wherein the excess thickness (12A) has a height of between about 2 mm and about 6 mm.

17. The system according to claim 11, wherein the electrically conducting material (10A) is embedded in the underlying dielectric material.

18. The system according to claim 11, wherein the electrically conducting material (10A) is fastened to the underlying dielectric material.

19. The system according to claim 11, wherein the excess thickness (12A) is formed as a single piece with the end wall (12) of the container which is formed in the said underlying dielectric material.

20. The system according to claim 11, wherein the excess thickness (12A) is fastened to the end wall (12).

21. The system according to claim 11, wherein the ratio of the height of the excess thickness (12A) to the depth of the container is less than 0.3.

22. The system according to claim 11, wherein the container constitutes a tool or part of a microwave oven (1).

23. The system according to claim 11, wherein the dielectric material has a dielectric constant greater than 2.

24. The system according to claim 11, wherein the ratio of the height of the excess thickness (12A) to the depth of the container is about 0.1.

* * * * *